US010668507B2

(12) United States Patent
Nijland

(10) Patent No.: US 10,668,507 B2
(45) Date of Patent: Jun. 2, 2020

(54) SORTING SYSTEM FOR SORTING PRODUCTS AND METHOD THEREFOR

(71) Applicant: DE GREEF'S WAGEN-, CARROSSERIE- EN MACHINEBOUW B.V, Tricht (NL)

(72) Inventor: Wilhelm Jan Nijland, Veenendaal (NL)

(73) Assignee: DE GREEF'S WAGEN-, CARROSSERIEEN MACHINEBOUW B.V., Tricht (NL)

( * ) Notice: Subject to any disclaimer, the term of this patent is extended or adjusted under 35 U.S.C. 154(b) by 0 days.

(21) Appl. No.: 15/739,114

(22) PCT Filed: Jun. 17, 2016

(86) PCT No.: PCT/NL2016/050432
§ 371 (c)(1),
(2) Date: Dec. 21, 2017

(87) PCT Pub. No.: WO2016/209071
PCT Pub. Date: Dec. 29, 2016

(65) Prior Publication Data

US 2018/0169708 A1 Jun. 21, 2018

(30) Foreign Application Priority Data

Jun. 22, 2015 (NL) ..... 2015008

(51) Int. Cl.
*B07C 5/16* (2006.01)
*B07C 5/342* (2006.01)
(Continued)

(52) U.S. Cl.
CPC ..... *B07C 5/3422* (2013.01); *B07C 5/12* (2013.01); *B07C 5/16* (2013.01); *B07C 5/34* (2013.01); *B07C 2501/009* (2013.01)

(58) Field of Classification Search
CPC .... B07C 5/02; B07C 5/04; B07C 5/10; B07C 5/12; B07C 5/16; B07C 5/34;
(Continued)

(56) References Cited

U.S. PATENT DOCUMENTS 5,406,770 A * 4/1995 Fikacek ..... B65B 5/105 53/155
6,546,304 B2 * 4/2003 Thorvaldsson ..... A22B 5/0064 700/115
(Continued)

FOREIGN PATENT DOCUMENTS

EP 0111877 A1 6/1984
FR 3014710 A1 6/2015
WO 2016209071 A1 12/2016

OTHER PUBLICATIONS

International Search Report and Written Opinion dated Oct. 17, 2016 in International Patent Application No. PCT/NL2016/050432, 9 pages.

*Primary Examiner* — Joseph C Rodriguez
(74) *Attorney, Agent, or Firm* — Shook, Hardy & Bacon, L.L.P.

(57) ABSTRACT

A sorting system for sorting products, in particular vulnerable products, such as apples and pears, and a method therefor. The sorting system comprises a singulator, a measuring system, and a sorting device provided with a number of sorting outlets, along with a control operatively connected to the measuring system and the sorting device, and provided with a classification system. The control is provided with a selection module configured to switch the sorting system between a basic configuration and a task configuration in which the selection module is configured to select sorting commands and to couple a sorting command to one or more of the available sorting outlets adaptable to the specific product properties by the control. A product allo-
(Continued)

cation system is configured to distribute assessed products over the qualifying sorting outlets in the task configuration.

20 Claims, 3 Drawing Sheets

(51) Int. Cl.
*B07C 5/34* (2006.01)
*B07C 5/12* (2006.01)

(58) Field of Classification Search
CPC ..... B07C 5/342; B07C 5/361; B07C 5/38; B07C 2501/0081; B07C 2501/009; G01G 13/003; G01G 19/00
USPC ..... 209/551, 555
See application file for complete search history.

(56) References Cited

U.S. PATENT DOCUMENTS 6,898,482 B2 * 5/2005 Thorvaldsson ..... A22B 5/0064 452/150
7,383,695 B2 * 6/2008 Lehman ..... C03B 1/00 209/930
RE40,797 E * 6/2009 Asgeirsson ..... B07C 5/38 177/1
8,091,712 B2 * 1/2012 Thorsson ..... G01G 19/303 209/559
8,985,341 B2 * 3/2015 Lapeyre ..... B07C 5/00 209/546
9,886,752 B2 * 2/2018 Taylor ..... G01G 17/00
2007/0293980 A1 * 12/2007 Gudjonsson ..... A22C 17/0093 700/223

* cited by examiner

SORTING SYSTEM FOR SORTING PRODUCTS AND METHOD THEREFOR

CROSS-REFERENCE TO RELATED APPLICATIONS

This application claims priority under 35 U.S.C. § 365 to PCT/NL2016/050432, filed on Jun. 17, 2016, entitled "SORTING SYSTEM FOR SORTING PRODUCTS AND METHOD THEREFOR," which claims priority to Netherlands App. No. 2015008 filed on Jun. 22, 2015, the entirety of the aforementioned applications are incorporated by reference herein.

SUMMARY

The present invention relates to a sorting system for sorting products, in particular vulnerable products, such as vegetables and fruit, and more particularly fresh fruit such as apples and pears.

Sorting systems for sorting vulnerable products, such as apples and pears, are known in practice. Such a conventional sorting system is described in NL 2003166, which describes particularly a holder for sorting and/or transporting such products. In such systems a quantity of products is supplied, then singulated, measured and transported to the corresponding sorting outlet of the sorting system. In these conventional sorting systems the sorting outlets of the sorting device are set on the basis of a classification associated with the product in question. Each classification is coupled here to one or more outlets of the sorting system. This limits the flexibility for use of a completely or partially different classification. In practice, differing classifications must therefore usually be collected separately at a later time.

The object of the present invention is to provide a sorting system whereby the above stated problems are obviated or at least reduced.

The present invention provides for this purpose a sorting system for sorting products.

The sorting system according to the invention particularly has for its object to sort preferably fresh products, such as potato, vegetable or fruit products, and particularly apples and pears. The products are supplied to the sorting system via for instance a feed belt or other feed conveyor. The supplied products are singulated using a singulator, such that product properties of the products can then be determined using a measuring system. After the product properties have been determined the products are carried further via the sorting device, which is provided with a number of sorting outlets. The product is then delivered to the desired sorting outlet. Use is for instance made here of the holder described in NL2003166.

The product properties are for instance one or more of the following: dimensioning of the product, colour of the product, external quality, weight, internal quality and the shape of the product. If desired, alternative and/or additional product properties can be employed.

According to the invention, the sorting system can be used in a basic configuration. The sorting outlets are set here on the basis of a standard classification. Measured products are assessed and classified using the classification system. The classified products are then delivered or offloaded by the sorting device to or at the relevant sorting outlet of the sorting device, which is coupled to this sorting group. It is thus for instance determined with the sorting system that a product with a dimensioning of 70-75 mm, the colour green and quality I will go to outlet 17 of the sorting device.

According to the invention, the sorting system can further be used in a task configuration. The control of the sorting system is provided for this purpose with a selection module which preferably comprises a switch mechanism or activator for switching between the different configurations.

One or more specific task sorting commands with specific product properties, which are employed by the sorting system in addition to and/or instead of the standard classification, are selected in the task configuration. The specific task sorting command is employed for a period of time and/or until a determined quantity of products complying with the specific task sorting command has been sorted. The specific task sorting command is coupled to a sorting outlet which is adapted thereto by the control.

Because of the combination of a standard classification and a specific task sorting command it may occur in the task configuration of the sorting system that more than one sorting outlet qualifies for a product assessed with the classification system. The classification system for instance makes the assessment that a product falls within a standard class as well as within the class of the specific task sorting command. The product allocation system of the control distributes the products over the qualifying sorting outlets in the task configuration. A determined allocation formula can be employed here wherein use is made of for instance weighting factors and/or set priority levels, or it is possible to determine that the specific sorting command has priority over the standard classification.

The allocation system can for instance prioritize one or more specific task sorting commands over the standard sorting settings, i.e. the basic sorting/standard classification. It is also possible to employ a specific ratio of the distribution of qualified products over the qualifying sorting outlets, such that it is prevented that a specific sorting outlet remains without products for some considerable time. This of course depends on the specific priority of a specific sorting command.

After a task sorting command has been concluded, for instance because a quantity of desired products has been sorted, the command in question ends and the sorting system is adjusted for the subsequent task sorting command and/or switches to the basic settings in the basic configuration. The task in question preferably remains retrievable in a sorting task database for registration and/or renewed application.

Depending on the sorting system and for instance the number of sorting outlets of the sorting device, it is possible to execute multiple task sorting commands simultaneously in the task configuration of the sorting system. As stated above, in the case of overlap between the specifications of different sorting outlets, the sorting outlet, among the qualifying sorting outlets, where a product is to be offloaded is chosen using the product allocation system.

In the task configuration of the sorting system a sorting outlet can be set in preferably fully automatic manner using the control, such that a specific assortment according to the specific task sorting command is obtained at at least one of the sorting outlets of the sorting device. This assortment according to the specific task sorting command can then be treated and transported in desired manner. Such a preferably automatic setting of the sorting outlet in the task configuration results in a flexible sorting process in the sense that it is possible to effectively and efficiently manage specific task sorting commands beyond the normal standard sortings to which a conventional sorting device is geared.

A sorting system can for instance be provided with sorting groups on the basis of a dimensioning, for instance with specifications per sorting outlet of 70-75 mm, 75-80 mm, 80-85 mm, in combination with colour and quality characteristics. This forms the standard classification. If a task sorting command to deliver 1000 kilos of product, for instance as 10 crates of 100 kg each, with the specification green, 73-81 mm and quality I is received, the sorting system switches from a basic configuration to a task configuration and this assortment according to the specific task sorting command is allocated to a specific sorting outlet. The sorting outlet is set accordingly by the control. Products falling within this specification are then delivered to this sorting outlet. As already stated above, a product falling within this specific assortment can optionally also be delivered to another sorting outlet with a standard class setting in the case of an overlap. The product allocation system allocates the product to one of the qualifying sorting outlets. The sorting outlet preferably remains coupled to the specific (task) sorting until the desired quantity of products has been reached. The product allocation system can here employ a priority per sorting command. If desired, such a priority can be entered manually and can optionally be adjusted by the operator of the sorting system. The priority can also be set automatically based on for instance demand, as well as on stock levels, progress of the task, delivery time to be realized, product values, and the presence/availability of the products required for executing the sorting command.

Preferably allocated to the sorting tasks with the highest priority are the outlets of the sorting system which are not used by the sorting program in the basic configuration. It may occur that there are more sorting tasks than available outlets, whereby sorting tasks with a lower priority do not "take part" in the sorting and an outlet is not allocated thereto in the first instance. In the case that the priority of a sorting task without outlet is raised, so that it has a higher priority than one of the sorting tasks with output, one of the sorting tasks with a lower priority is optionally uncoupled from an outlet and the task with a higher priority is coupled to this outlet as soon as a monitoring system indicates that all fruits of the previous sorting task have been removed from the outlet. Mixing of products from different classes is hereby prevented. A suitable moment is preferably chosen for uncoupling an outlet from a sorting task, for instance when a crate at such an outlet is full.

In one of the preferred embodiments according to the invention the sorting device sorts continuously on the basis of the standard classification, and the task configuration is activated for a specific task sorting command. Such a task sorting command preferably automatically has a higher priority than the standard classification. While the task sorting command is active, products falling within the task are sorted. The task is preferably stopped as soon as enough products for the task have been sorted. Products which do not meet the standards of the task sorting command are for instance sorted according to standard classification.

In a possible embodiment measurement takes place at a sorting outlet of whether products are passing, and preferably also of how many. It is hereby possible to give feedback to the sorting system. If no products pass for some time, the sorting outlet can for instance be released for another task with settings with which products do comply, so that the relevant sorting outlet is utilized.

In a possible embodiment it is further for instance possible with the system according to the invention to class all common product groups, for instance 100 groups or classes per fruit/variety, in a task list, wherein the production demand and the priority are entered per product group and only the sorting tasks with a high priority are sorted. A system is hereby created wherein for instance the operator of the machine need only enter this task list and a basic configuration/basic sorting program once. The actual sorting takes place by automatically giving priority to the tasks with the highest priority until the production demand has been met, after which other tasks are carried out. Changing the sorting is thereby reduced to changing the priority of one or more specific tasks. In an advantageous embodiment it is also possible, in addition to sorting on the basis of priority, to sort on the basis of the combination of (task) priority and the availability of classified fruits. A sorting task which does have a high priority and for which not enough fruits are available in the supplied batch can thus be prevented from making use of an outlet and thereby blocking another sorting task. The capacity of the sorting system can in this way be utilized optimally.

Using the sorting system according to the invention a sorting command with for instance a non-standard sorting can be processed by the sorting system in simple and preferably automatic manner. A flexible sorting system is hereby provided which enables specific sorting commands to be managed in simple manner. A specific sorting command can therefore be executed and delivered more quickly with the sorting system according to the invention. This further prevents additional sorting steps, such that the sorting system according to the invention can be applied effectively for specific sorting commands.

The basic configuration can optionally be such that all products are sent to one or several outlets. Sorting then in fact only takes place on the basis of sorting tasks. Products falling outside the sorting tasks are then not further sorted and end up as it were in a remaining group, possibly for later processing.

A single sorting task can optionally further comprise a plurality of product groups. This is for instance interesting if a composition of products having for instance different colours has to be made. Mixing steps after the sorting process are avoided by directly sorting the desired composition at a single outlet as according to the sorting tasks. The efficiency of the sorting process is hereby increased further.

In an advantageous preferred embodiment according to the present invention the product properties comprise at least one of the following properties: size, colour, external quality, weight, internal quality and shape.

By selecting on the basis of product properties, the sorting system can provide an assortment in effective manner. A non-standard sorting command can hereby in particular be executed in efficient manner. Such a non-standard sorting command for instance has a differing dimensioning and/or a differing colour classification and/or weight classification and/or shape.

It is additionally or alternatively possible to sort on the basis of external qualities of the product. This is for instance possible by detecting defects, such as damage and diseases, on the surface of the products. Use can for instance be made for this purpose of a camera box in which a recording of the product, particularly of the skin of the product, can be made using cameras and for instance LED lighting. It is thus for instance possible to make for example sixty recordings of the skin, wherein the recordings are subsequently analysed. In a currently preferred embodiment the defects found are then projected onto a three-dimensional model of the product. Following this, a classification can be made on the basis of these properties. External quality can optionally also be determined using UV light or other techniques. External quality can be determined in an external quality determination module which is for instance placed at the end of the singulator.

The internal quality can additionally or alternatively be used as product property. Internal brown and Brix value of a product are for instance determined herein using for example a transmission technique. In a currently preferred embodiment use is made herein of spectrum analysis.

Shape characteristics for instance relate to the curvature of determined products, such as cucumbers. These characteristics can likewise be applied additionally or alternatively in the sorting system.

The system can additionally or alternatively be provided with a weight sensor. In a currently preferred embodiment this weight sensor is provided in a 3-point weighing system in a transfer unit and/or in the holders/cups of the sorting device. Such a transfer unit is for instance described in NL1003057 and in NL10168186.

In an advantageous preferred embodiment according to the present invention the system comprises setting means for setting a tolerance in class widths of products.

By providing setting means and because the setting means operate fully automatically, preferably after product properties and optional tolerances are entered, it is achieved that, for the entered product properties of a specific class and sorting outlet coupled thereto, the limits of one or more product properties are expanded and the relevant sorting outlet(s) is adapted thereto.

In the case of the following product properties: a size in the range of 70-75 mm, colour 400-500, bloom 50-70% and quality 1.00-1.50, a tolerance of 20% in the class widths will for instance result in a sorting having the following properties: 69.5-75.5 mm, colour 390-510, bloom 48%-72%, quality 0.95-1.55. As a result, the quantity of product falling within the sorting task becomes much greater, i.e. 20% more per product property. In this example this means an increase of 4*20%=80%. This tolerance can preferably be set per product property, making it is possible to aim specifically for an production increase by means of limit adjustments acceptable within the product group.

In a currently preferred embodiment products falling within the relevant class are sorted and sent to a sorting outlet. Products from the tolerance range are only added to the assortment/let through to the relevant sorting outlet if the class midpoint of the specified product group is approximated more closely thereby. It is hereby possible in for instance a sorting group with weight 140-160 grams and a tolerance of 30% to reach an exact average fruit weight of 150 grams, whereby packagings of 100 pieces in 15 kg boxes can then be made. This compensates for too much variation in the weight distribution of the supplied fruits and ensures a stable output. This can also be applied for the other product properties, in combination with or in addition to weight.

Products are preferably measured and the information is monitored per sorting outlet, such that the right products for approximating for instance the set and desired class midpoint as well as possible are allocated to a sorting outlet. Tolerance limits can optionally be adjusted in automatic manner and/or manually. A stable system is hereby obtained with which a stable outflow of sorted products is obtained.

In an advantageous preferred embodiment according to the present invention the sorting system comprises a priority coupling for coupling the control to a stock control system and/or logistical planning system and/or sales order system.

With the system wherein a sorting task is defined and placed in a list per product group, this specific task can be automatically coupled to a sales order system or stock control system or logistical planning system by adding to the task for instance the product code and product name employed in the sales system or stock system. The demand for the product and the priority of the product can be entered within these systems. The demands and priorities from the sales order system or logistical planning system or stock control system can then be automatically coupled to each other on the basis of the product code.

By providing a priority coupling a further optimization of the sorting can be carried out. It is hereby possible on the basis of the stock control and/or logistical planning and/or sales orders to adjust the priority of specific commands and/or to adapt the distribution of products over qualifying sorting outlets thereto with the product allocation system. The system is hereby configured even more effectively.

In a further advantageous preferred embodiment according to the present invention the sorting system comprises a user interface for entering sorting commands remotely.

A flexible sorting system is provided by providing a user interface configured to enter sorting commands remotely. The user interface is for instance a touchscreen or another, optionally centrally deployed, computer system. The sorting system is hereby configured more effectively and made more user-friendly. The sorting system according to the invention preferably operates wholly or at least largely automatically or autonomously. Manually entered actions or corrections, for instance via the user interface, are preferably also possible. These actions or corrections are for instance pausing, ending, restarting, copying, adjusting the priority, adjusting the demand, adjusting the product properties, adjusting the product code, adjusting the allocation formula, adjusting the packaging properties, adjusting the sticker/label properties, adjusting the destination.

In a further advantageous preferred embodiment according to the present invention the sorting system comprises a packaging device configured to package products sorted per sorting command.

By providing the sorting system according to the invention with a packaging device, the products of an executed sorting command can be packaged immediately such that they can be transported further in effective manner. The packaging device is preferably provided with a labelling device configured to label a packaging with sorted products with mention of information from the sorting command. A quantity of sorted products is hereby delivered in effective manner by the sorting system according to the invention. If the production volume of a sorting task is specified as a discrete number of fillings for the packaging device, the sorting task can in an advantageous embodiment be interrupted after completion of a filling in favour of a sorting task with higher priority, without resulting in packagings which are not completely filled. A specific sorting task preferably comprises information about the type of packaging, content of the packaging to be achieved, content of the print on the packaging, destination of the packaging. This information can for instance be used effectively by a labelling device and be provided to the products and/or packagings via for instance a barcode on a label/sticker/direct print. Label, sticker and direct print are understood as exchangeable information carriers. The relevant information can hereby for instance be retrieved by users further along the chain. In addition to sorting task information, the relevant information can also relate to product information such as origin, variety and so on.

The present invention further relates to a method for sorting products, particularly vulnerable products such as fresh fruit.

The method provides the same advantages and effects as described for the sorting system. Achieved in particular with the method according to the invention is that a sorting command with non-standard sorting is executed in effective manner. The provided sorting device is preferably (part of) an embodiment of the above described sorting system.

In a currently preferred embodiment the method comprises of providing in the task configuration a distribution by the product allocation system whereby assessed products are allocated to one of the possible qualifying sorting outlets. In the basic configuration a classified product will usually be coupled to one sorting outlet which is allocated to the relevant class. A plurality of sorting outlets can however qualify for a product in the task configuration since the sorting command can have an overlap with the standard classification. According to the invention, an allocation methodology is preferably employed for this purpose. Use can be made here of the priority of the specific sorting commands, wherein an allocation formula can if desired be employed, wherein products are distributed over the qualifying outlets as according to this allocation formula.

The (tolerance) limits of a class are preferably provided in a manner in which they can be set with setting means in automatic manner. The tolerance limits can preferably be set such that a desired class average is approximated more closely. It can hereby be ensured that sorted products lie with an average of a product property on the basis of which sorting takes place at for instance the midpoint of the class in question. The average of an assortment is hereby maintained in this example. With this aspect according to the invention it becomes possible to set tolerance limits for a range of a product property on the basis of which sorting takes place, such that a value for this product property is maintained in an assortment. This setting is preferably adjusted in automatic manner during the sorting on the basis of obtained measurement data and product allocation information.

After a sorting command has been executed, the coupled sorting outlet preferably becomes available for a subsequent sorting command or to return to the basic configuration with a basic setting and standard classification.

The effectiveness of the sorting system according to the invention is increased further by the option of using the sorting system in a task configuration.

The method according to the invention preferably comprises the step of setting the product allocation system using a priority coupling to a stock control system and/or logistical planning system and/or sales order system. It is hereby made possible to adjust the product sorting on the basis of stock and/or the logistical planning and/or sales orders. The sorting can hereby be carried out in effective manner.

The method further preferably comprises the additional step of packaging sorted products with a packaging device and in addition preferably of labelling a packaging with information from the sorting command, such as product code and production time and so on, and/or product information such as product origin, variety and so on. The packaging or product can be provided for this purpose with a barcode whereby the desired information can be retrieved. A specific sorting command can hereby be executed and dispatched in effective manner and within a short period of time. Errors in packaging, labelling and/or additional sorting are hereby avoided.

BRIEF DESCRIPTION OF THE DRAWINGS

Further advantages, features and details of the invention are further elucidated below on the basis of preferred embodiments thereof, wherein reference is made to the accompanying drawings, in which.

DETAILED DESCRIPTION

Figure 1:
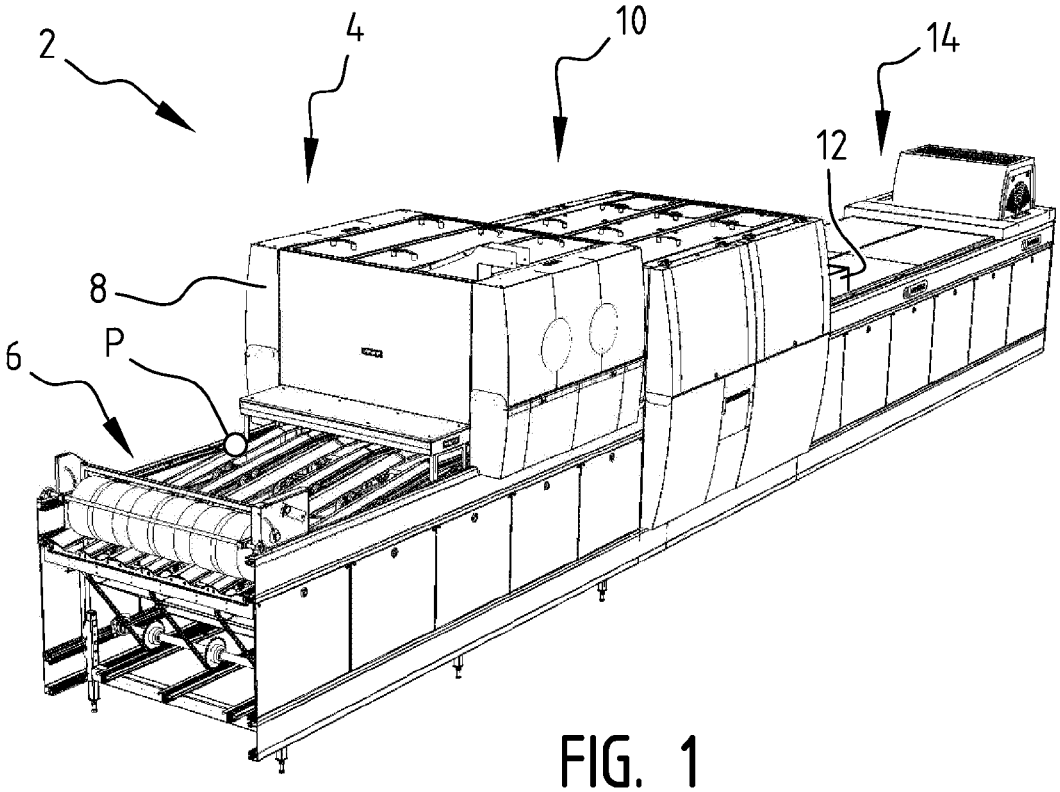
FIG. 1 shows a view of the sorting system according to the invention.

Sorting system 2 (FIG. 1) comprises measuring part 4 which is substantially provided at the end of a singulator 6 on which supplied products P are singulated. Placed at the end of singulator 6 is an external quality assessment system, such as iQs module 8, to assess defects on the surface of product P. After the external quality has been determined, products P are in the shown embodiment transferred to holders of system 2 using transfer system 10. Transfer system 10 is for instance of the type as described in NL 1003057 and NL101686. It will be apparent that other transfer systems 10 can also be utilized in sorting system 2. In the shown embodiment products P in the holders are then assessed in internal quality measurement system 12 on the basis of the internal quality using transmission techniques, for instance using a so-called iFA module 12. This can be carried out on products in the holders or cups of sorting device 14, for instance carried out as described in NL 2003166. It will be apparent that it is also possible to use other sorting devices 14 in sorting system 2.

Products P can be weighed using a measuring sensor while being transferred by transfer system 10 and/or transported in the holders of sorting device 14.

Figure 2:
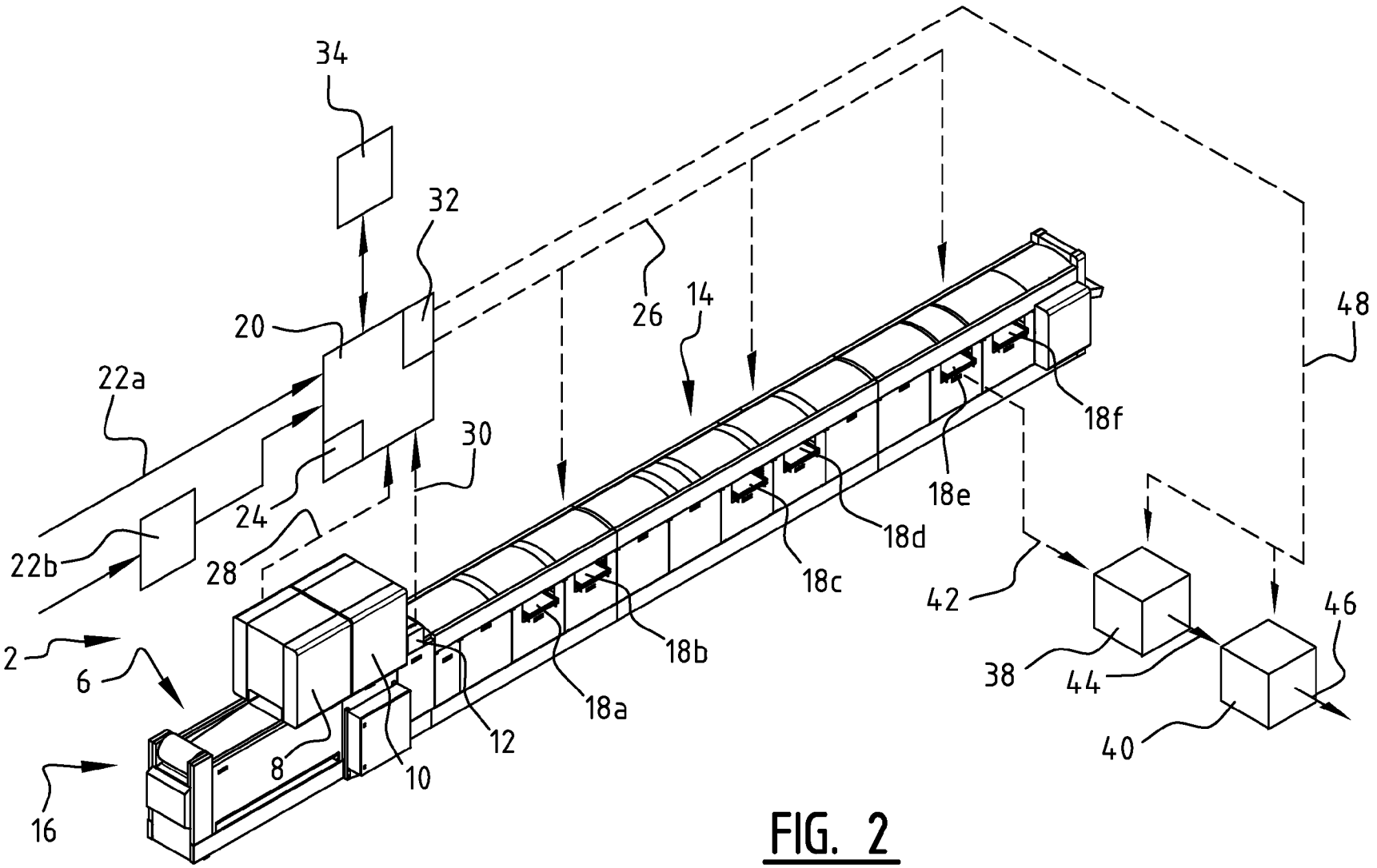
FIG. 2 shows a further view of the system according to the invention.

Sorting device 2 (FIG. 2) is provided with feed system 16 whereby products P are supplied to singulator 6. Products are then carried using measuring models 8, 10, 12 to sorting device 14, which is provided with a number of sorting outlets 18*a*, 18*b*, 18*c*, 18*d*, 18*e* and 18*f*.

Sorting system 2 is controlled using control 20. Control 20 receives a command 22*a* from an operator and/or from a user interface such as touchscreen 22*b*. In the shown embodiment control 20 is provided with selection module 24 or at least operatively connected thereto for the purpose of selecting a sorting command to be executed and then coupling a sorting command with specific product properties to one or more of the available sorting outlets 18*a-f*. Control 20 sends setting values 26 to relevant outlets 18*a-f* for this purpose. In the shown embodiment control 20 tracks the position of the fruits on the basis of an encoder which measures the displacement of the holders of system 2. When the position of the fruit nears the sorting outlet, control 20 activates the offloading mechanism whereby the fruits are offloaded at the sorting outlet.

Control 20 receives measurement information 28, 30 from the different measuring modules 8, 12 and classifies products P. Product allocation system 32 then allocates individual products P to one of the qualifying sorting outlets 18*a-f*. Control 20 is optionally connected to stock control system/logistical planning 34 with which information 36*b* can be exchanged. Information 36 can for instance be used to select a sorting command in selection module 24 and/or to employ an allocation formula in product allocation system 32.

In the shown embodiment sorting system 2 is operatively connected to packaging device 38 and then to labelling device 40. Product flow 42 from one of the sorting outlets 18*a-f* is carried to packaging device 38 and product flow 44 is then fed through to labelling device 40, after which the labelled and packaged products are dispatched via flow 46. Information 48 is exchanged with packaging device 36 and labelling device 40 from control 20. This packaging device can for instance be a filling system for bags of fruit with a content of for instance 2 kg, but also a filling system for large crates with a content of for instance 300 kg.

Figure 3:
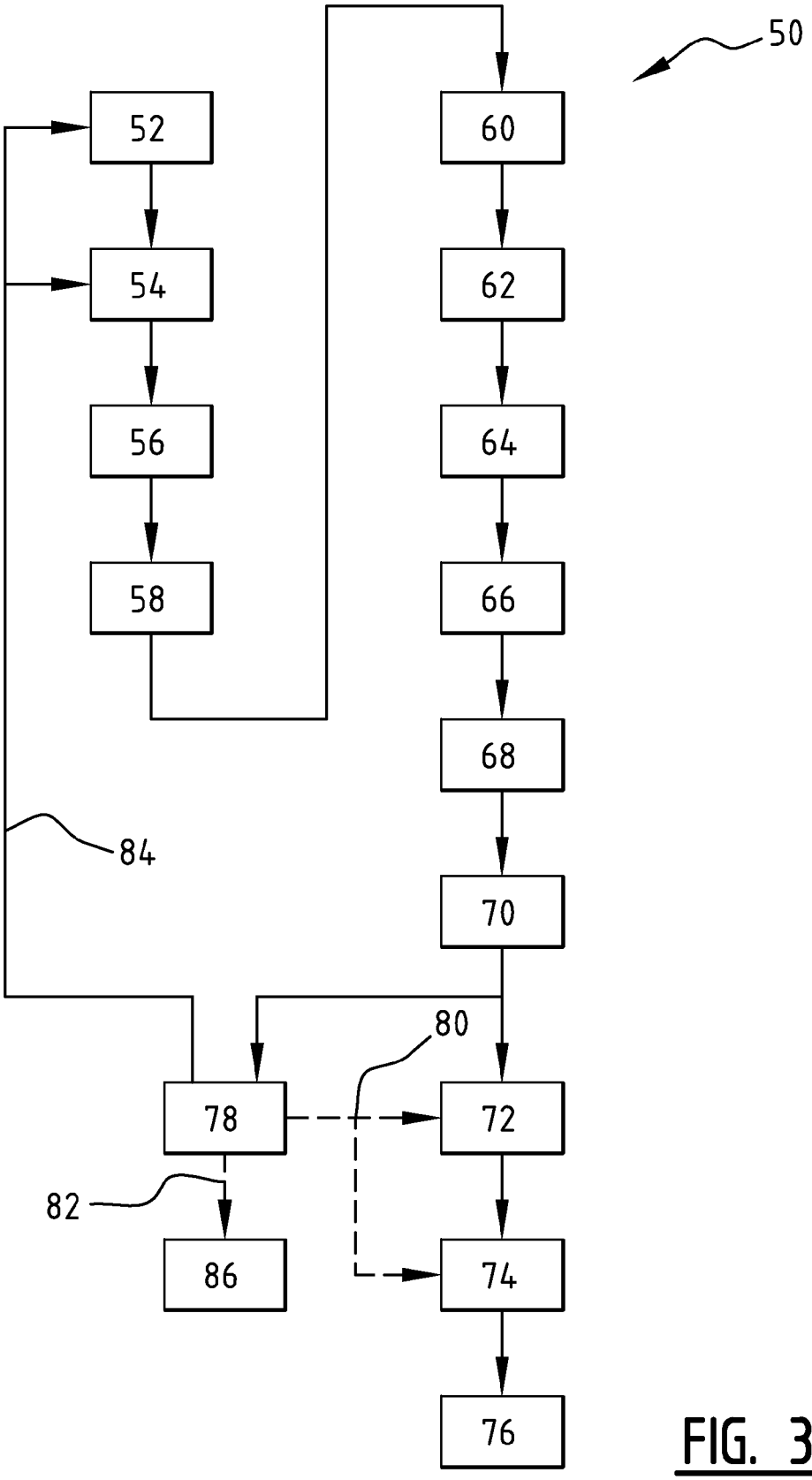
FIG. 3 shows a schematic view of the process steps for the sorting system according to the invention.

For the sorting 50 (FIG. 3) of products such as apples and pears sorting system 2 is provided with a standard setting 52 in a basic configuration. In an advantageous embodiment this is carried out by loading a sorting program into sorting system 2. After a command 54 has been received a selection or optimization 56 is carried out, wherein sorting commands are selected and are coupled to a specific sorting outlet. This can preferably be done online, wherein priorities of individual tasks can if desired be adjusted, for instance depending on the demand for a product. The sorting system switches to a task configuration herein. In an advantageous embodiment this is done by loading a task list into sorting system 2. Setting 58 of the relevant sorting outlet then takes place on the basis of the specific product properties. Products are then supplied in supply step 60. After singulation 62 thereof, products P can optionally be measured externally 64 and if desired be transferred 66 using transfer device 10, after which the internal quality can optionally be measured 68. It will be apparent that the measuring steps can also be performed in a different order and with more or fewer measuring steps.

Using control 20, products P are then sorted in sorting device 14 and distributed over sorting outlets 18*a-f* in sorting and allocating step 70. This sorting relates to the processing of the supplied measurement data relating to product P, after which the relevant data of the product P in question are compared to the specifications of a task and allocated to a sorting outlet. Use is made here in the task configuration of allocation system 32. If product P does not fit within a task it is possible to compare the relevant data of the product P in question to specifications of the sorting program and to allocate product P to a "standard" sorting outlet. The allocation of product P to a sorting outlet is preferably also tracked during sorting, so that data are for instance available for labelling.

Control 20 with setting means, for instance a tolerance setting program, sets a tolerance for the limits of a sorting outlet. These tolerance settings are, if necessary, preferably adjusted during sorting. Adjustment for instance takes place if the average of a product property on the basis of which sorting takes place varies over time. By adding a product which falls outside the class width but within the tolerance limits, the average in question is influenced to take on a desired value, or a value closer thereto. The average value of an assortment can thereby be maintained more effectively and for instance be kept constant over time more effectively.

A sorted batch of products P is then packaged 72 and provided with label 74, and then further dispatched 76.

After a sorting task has been completed, a sorting command is terminated 78. Possible information is supplied 80 to packaging device 38 and/or labelling device 40. Information 82 is if desired also supplied 86 for the purpose of planning and/or logistics and/or sales. Termination 78 of a command is then reported 84 to sorting system 2, after which it is possible to continue with standard setting 52 in a basic configuration or with accepting a new sorting command 54 in the task configuration.

It will be apparent that the above described measurements performed on the product, including internal quality, external quality and/or weight, can also be carried out in other ways, as long as a classification of the supplied product can be enabled.

The present invention is by no means limited to the above described preferred embodiments thereof. The rights sought are defined by the following claims, within the scope of which many modifications can be envisaged.

The invention claimed is:

1. A sorting system for sorting products, the system comprising:

a singulator for singulating supplied products;

a measuring system for determining product properties of the singulated products;

a sorting device provided with a number of sorting outlets for sorting the supplied products on the basis of selected product properties;

a control operatively connected to the measuring system and the sorting device, and provided with a classification system configured to determine on the basis of selected properties measured with the measuring system possible sorting outlets qualifying for an assessed product, wherein the control is further provided with:

a selection module configured to switch the sorting system between a basic configuration with standard set sorting outlets according to a standard classification of the selected product properties and a task configuration, wherein in the task configuration at least a part of the sorting outlets is set according to a specific classification of the selected product properties and is allocated to one or more task sorting commands aimed at one or more specific product properties, during sorting of an intended quantity of products in the task sorting command in addition to and/or instead of the sorting outlets set according to the standard classification, wherein the selection module is further configured to:

select in the task configuration the one or more task sorting commands, wherein each of the one or more task sorting commands has an associated priority ranging from a highest priority to a lower priority, and couple in the task configuration, at least partly based on the associated priority, the selected task sorting commands to one or more available sorting outlets adaptable to the specific product properties by the control, wherein the coupling automatically gives priority to the task sorting command with the highest priority; and a product allocation system configured to distribute assessed products over the qualifying sorting outlets in the task configuration, such that the assessed products can be sent to the allocated selected sorting outlet by the control.

2. The sorting system as claimed in claim 1, wherein the product properties comprise at least one of the following properties: size, color, external quality, weight, internal quality, and shape.

3. The sorting system as claimed in claim 1, wherein the measuring system comprises an external quality determination module.

4. The sorting system as claimed in claim 1, wherein the measuring system comprises a weight sensor.

5. The sorting system as claimed in claim 1, wherein the measuring system comprises an internal quality determination module.

6. The sorting system as claimed in claim 1, further comprising a setting means for setting a tolerance in class widths of products.

7. The sorting system as claimed in claim 1, further comprising a priority coupling for coupling the control to a stock control system and/or a logistical planning system and/or a sales order system.

8. The sorting system as claimed in claim 1, further comprising a user interface for entering sorting commands remotely.

9. The sorting system as claimed in claim 1, further comprising a packaging device configured to package products sorted per sorting command.

10. The sorting system as claimed in claim 9, wherein the packaging device comprises a labelling device configured to label a packaging with sorted products with mention of information from the sorting command.

11. A method for sorting products, the method comprising:

providing a sorting system;

supplying products for sorting;

singulating the supplied products using a singulator;

determining product properties of the singulated products using a measuring system;

switching from a basic configuration to a task configuration using a selection module;

selecting, in the task configuration and using the selection module, task sorting commands with one or more specific product properties to be executed, wherein each of the task sorting commands has an associated priority ranging from a highest priority to a lower priority;

coupling the selected task sorting commands to one or more available sorting outlets of a sorting device in the task configuration at least partly based on the associated priority, wherein the coupling automatically gives priority to the task sorting command with the highest priority;

classifying assessed products on the basis of measured product properties and determining qualifying sorting outlets in the task configuration;

allocating classified products to one of the qualifying sorting outlets using a product allocation system in the task configuration; and sending the classified products to the allocated qualifying sorting outlet.

12. The method as claimed in claim 11, wherein the product properties comprise at least one of the following properties: size, color, external quality, weight, internal quality, and shape.

13. The method as claimed in claim 11, wherein the product allocation system employs a distribution for distributing assessed products over qualifying sorting outlets.

14. The method as claimed in claim 11, wherein after a sorting command has been executed, the coupled sorting outlet becomes available for a subsequent sorting command and/or for a basic setting.

15. The method as claimed in claim 11, further comprising setting tolerance limits for a range of a product property on the basis of which sorting takes place, such that a value for the product property is maintained in an assortment.

16. The method as claimed in claim 15, wherein the tolerance limits are set such that a desired class average is approximated more closely.

17. The method as claimed in claim 11, further comprising setting the product allocation system using a priority coupling to a stock control system and/or a logistical planning system and/or a sales order system.

18. The method as claimed in claim 17, further comprising packaging sorted products using a packaging device and labelling a packaging with information from the sorting command and/or product information.

19. A sorting system for sorting products, the system comprising:

a singulator for singulating supplied products;

a measuring system for determining product properties of the singulated supplied products;

a sorting device provided with a number of sorting outlets for sorting the supplied products on the basis of selected product properties;

a control operatively connected to the measuring system and the sorting device, and provided with a classification system configured to determine on the basis of the selected product properties measured with the measuring system possible sorting outlets qualifying for an assessed product, wherein the control is further provided with:

a selection module configured to switch the sorting system between a basic configuration with standard set sorting outlets according to a standard classification of the selected product properties and a task configuration, wherein in the task configuration at least a part of the sorting outlets is set according to a specific classification of the selected product properties and is allocated to one or more task sorting commands aimed at one or more specific product properties, during sorting of an intended quantity of products in the task sorting command in addition to and/or instead of the sorting outlets set according to the standard classification, wherein the selection module is further configured to:

select in the task configuration the one or more task sorting commands, taking into account a priority of the task sorting commands, wherein each of the task sorting command has an associated priority ranging from a highest priority to a lower priority, and couple in the task configuration the selected task sorting commands to one or more available sorting outlets adaptable to the specific product properties by the control, wherein the coupling automatically gives priority to the task sorting command with the highest priority; and a product allocation system configured to distribute assessed products over the qualifying sorting outlets in the task configuration, such that the assessed products can be sent to the allocated selected sorting outlet by the control, taking into account the priority of the task sorting commands, further comprising setting means for setting a tolerance in class widths of products, a priority coupling for coupling the control to a stock control system and/or logistical planning system and/or sales order system, and a user interface for entering sorting commands remotely.

20. The sorting system as claimed in claim 1, wherein the sorting task commands with the lower priority do not take part in the sorting if there are more sorting task sorting commands than available sorting outlets.

* * * * *